United States Patent [19]

Buckholz

[11] Patent Number: 4,649,691

[45] Date of Patent: Mar. 17, 1987

[54] MULTIPLE ROTARY HEAD COLLATOR AND INSERTER

[75] Inventor: Frederick Buckholz, Brentwood, N.Y.

[73] Assignee: E. K. Mailing Machines Inc., Bay Shore, N.Y.

[21] Appl. No.: 822,884

[22] Filed: Jan. 27, 1986

[51] Int. Cl.[4] ..... B65B 5/06

[52] U.S. Cl. ..... 53/53; 53/54; 53/266 A

[58] Field of Search ..... 53/53, 54, 55, 266 A, 53/77, 57, 502, 501, 494, 495, 168

[56] References Cited

U.S. PATENT DOCUMENTS

| | | | |
|---|---|---|---|
| 2,058,005 | 10/1936 | Donnellan | 53/266 A X |
| 3,371,331 | 2/1968 | Buckholz | 340/259 |
| 3,411,443 | 11/1968 | Buckholz | 101/232 |
| 3,454,451 | 7/1969 | Buckholz | 156/513 |
| 3,568,401 | 3/1971 | Bonsch | 53/266 A X |
| 3,606,014 | 9/1971 | Linn | 53/53 X |
| 3,753,836 | 8/1973 | Buckholz | 156/521 |
| 4,079,576 | 3/1978 | Morrison et al. | 53/266 A |
| 4,571,925 | 2/1986 | Adams | 53/266 A X |

*Primary Examiner*—James F. Coan

*Attorney, Agent, or Firm*—Robert S. Stoll

[57] ABSTRACT

For use primarily in high-speed collating of multiple sheet inserts for mailing pieces, a series of rotary feed station means each having a plurality of gripping means are located above collating insert conveyor means. Each feed station feeds an insert, usually a single folded sheet, onto the conveyor at timed intervals such that the second feed deposits its insert onto the first insert, the third is deposited onto the first and second, etc., until all desired sheets are collected for inserting into an envelope.

21 Claims, 22 Drawing Figures

80
81
82
83
84
85
86
87
43

MULTIPLE ROTARY HEAD COLLATOR AND INSERTER

REFERENCE TO RELATED DOCUMENTS

Reference is made to disclosure document Ser. No. 134,639, filed Feb. 4, 1985.

SUMMARY OF THE INVENTION

Each rotary feed station means of the present mailing machine comprises rotary head means disposed beneath a stack of inserts. By means of a reciprocating holder and roller support on the bottom of the stack, the lowermost insert is removed from the stack with vacuum pullers into proximate contact with the top of the rotary head. Cam-actuated counter-rotating grippers on the rotary head engage the insert, clamping it to the rotary head, pulling the insert from the bottom of the stack, bringing it around to the bottom of the rotary head and disengaging it onto the conveyor and onto any previously desposited inserts.

Envelope feed means comprises envelope-opening means, preferably counter-rotating brush and suction assemblies, and delivery means which delivers the flap opened envelope to the flow of inserts on the conveyor. The envelope is either fully stopped or greatly slowed down relative to the speed of the conveyor-flow of inserts, whereby the inserts are driven into the open envelope. The filled envelope is then removed from the insert-conveyor by outflow conveyor means for further processing, normally to a postage meter.

Drive means comprise motor means drivingly connected to each rotary head means, the insert conveyor means and the envelope feed means by posture-drive members, preferably roller chains, sprockets and gears, to insure that all rotating and conveying members operate in timed unison.

By means of the present invention, inserts may be removed from stacks at high speed, collated and inserted into envelopes opened and delivered for the purpose. By reason of there being more than one set of grippers on each rotary head, the delivery rate of inserts is multiplied without need for higher rotary head speeds, thereby increasing feed accuracy and expanding the types and thicknesses of inserts which may be handled. Further, by reason of suitable detection, memory and diverting means, defectively fed inserts are withdrawn from the filled envelope stream before postage and addresses are applied, minimizing waste.

BRIEF DESCRITPION OF THE DRAWING

FIG. 1 is a schematic flow diagram illustrating the collating conveyor at the top, moving from left to right as viewed, carrying collated inserts into an opened envelope delivered to the insert point from right to left as viewed. The filled envelope is removed from the collating conveyor insert flow, the glue line on the envelope flap moistened, sealed closed and processed further such as fed through a postage meter and addressing station, sorted and stacked for mailing.

FIG. 11 shows a normal folded sheet feed, FIG. 12 shows a double-sheet misfeed and FIG. 13 shows a no-sheet misfeed.

Figure 11:
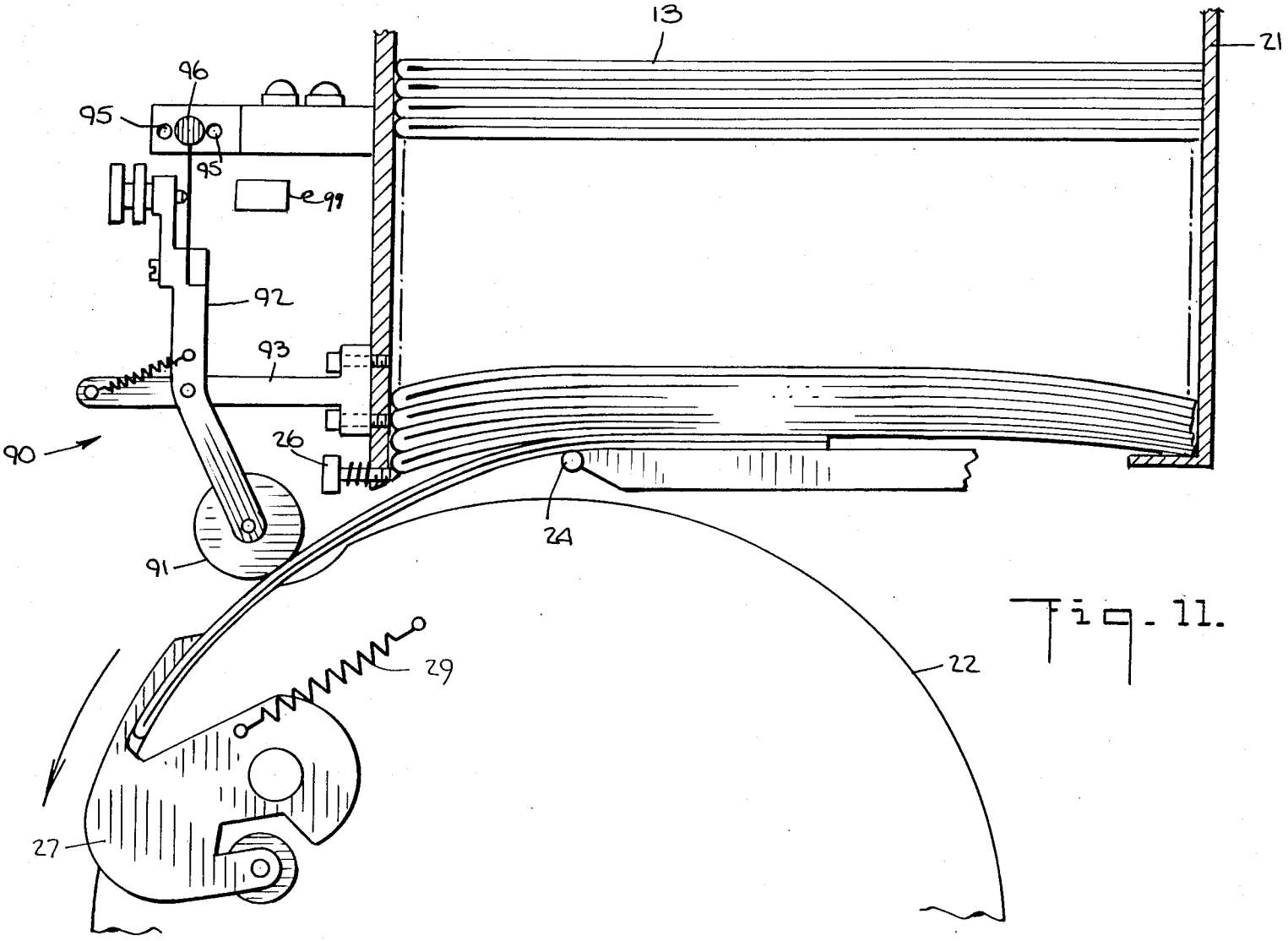
FIGS. 11, 12 and 13 are enlarged views, partly schematic, showing the misfeed detector means of the invention, located at the bottom of each insert stack and comprising a thickness sensor of the material fed into the rotary head.
Figure 13:
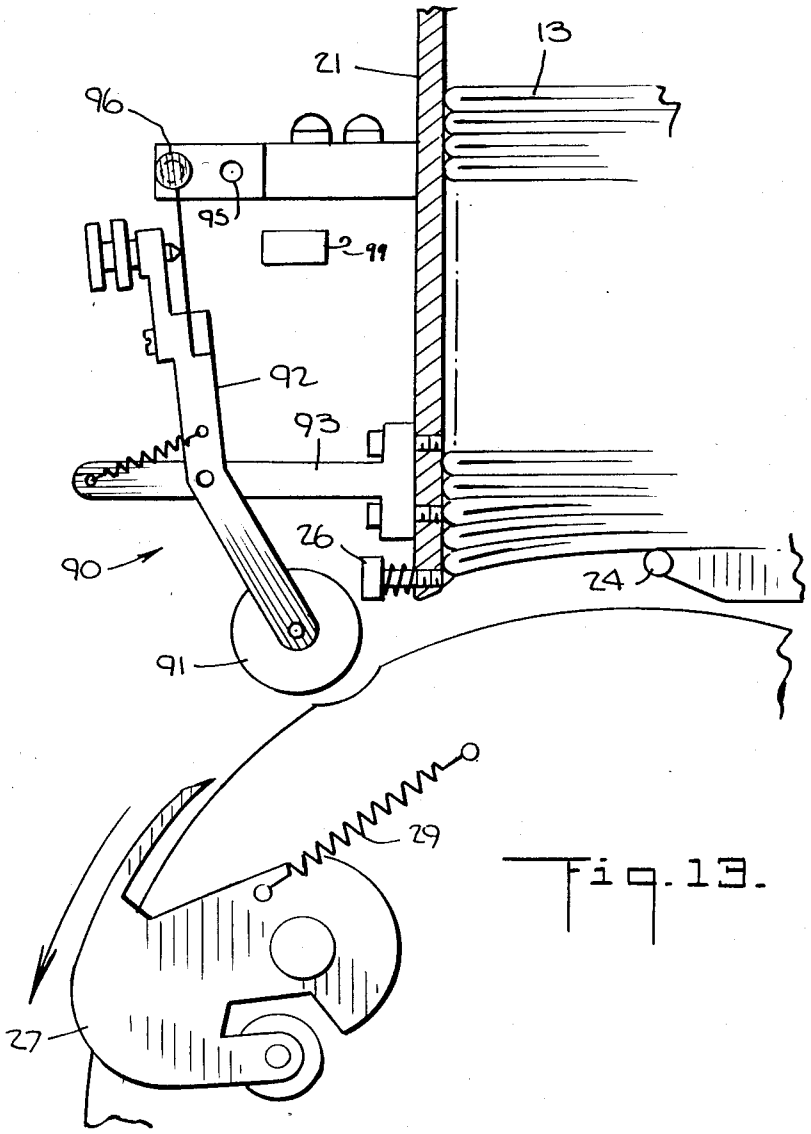
Figure 12:
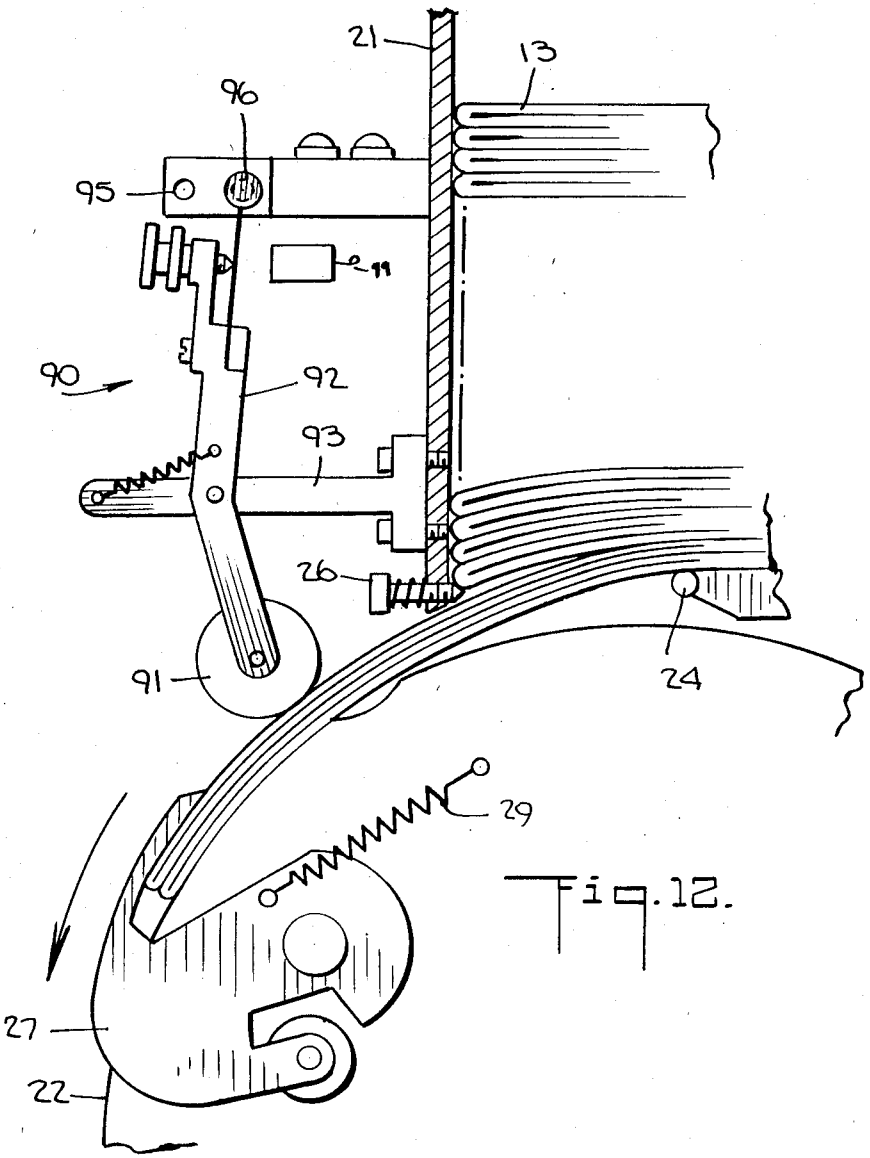

FIGS. 11, 12 and 13 also show, schematically, a sheet-sensing or detection means as described in U.S. Pat. No. 3,371,331, issued Feb. 27, 1968, at col. 2, line 55 et seq., incorporated herein by reference.

Figure 14:
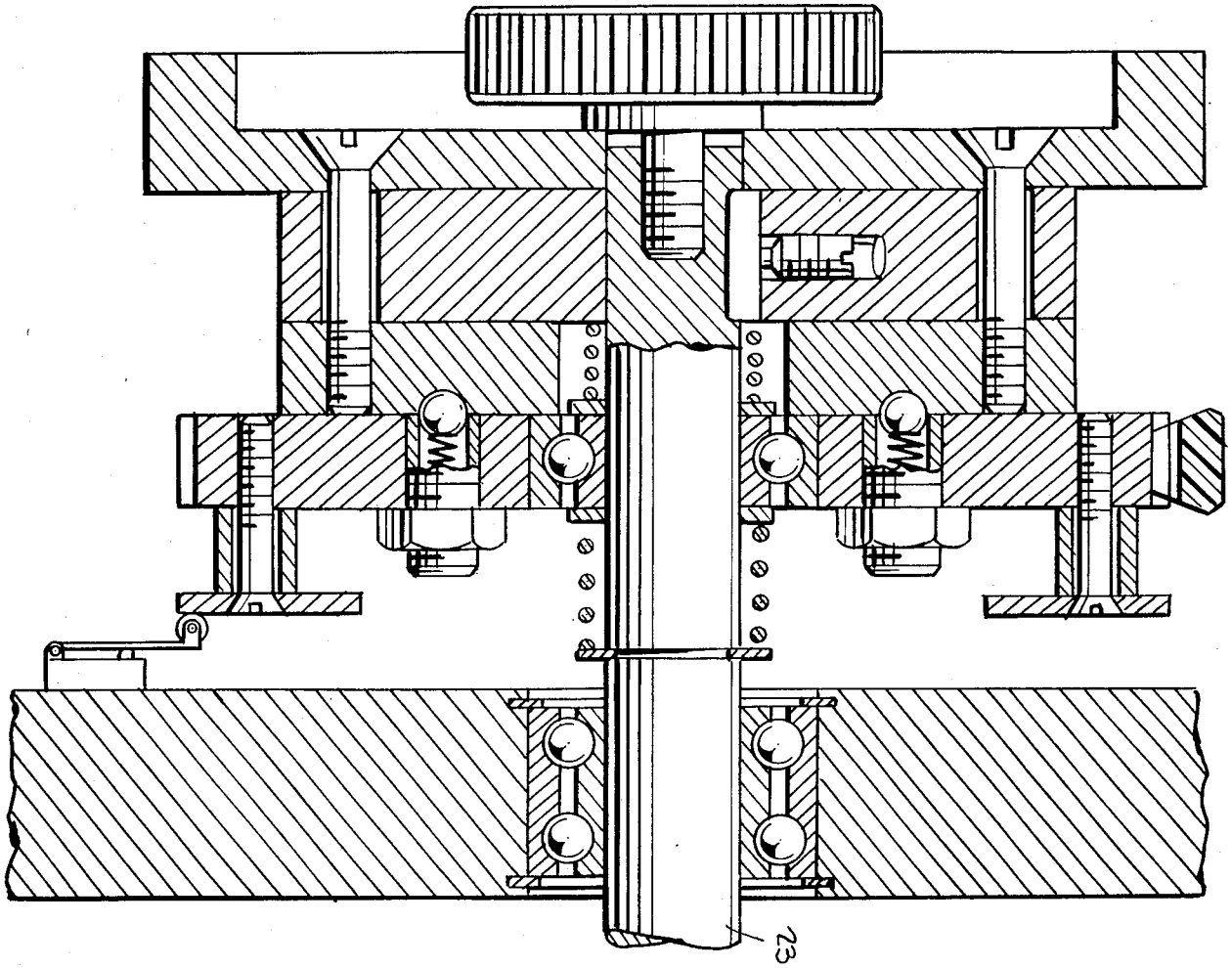
Figure 15:
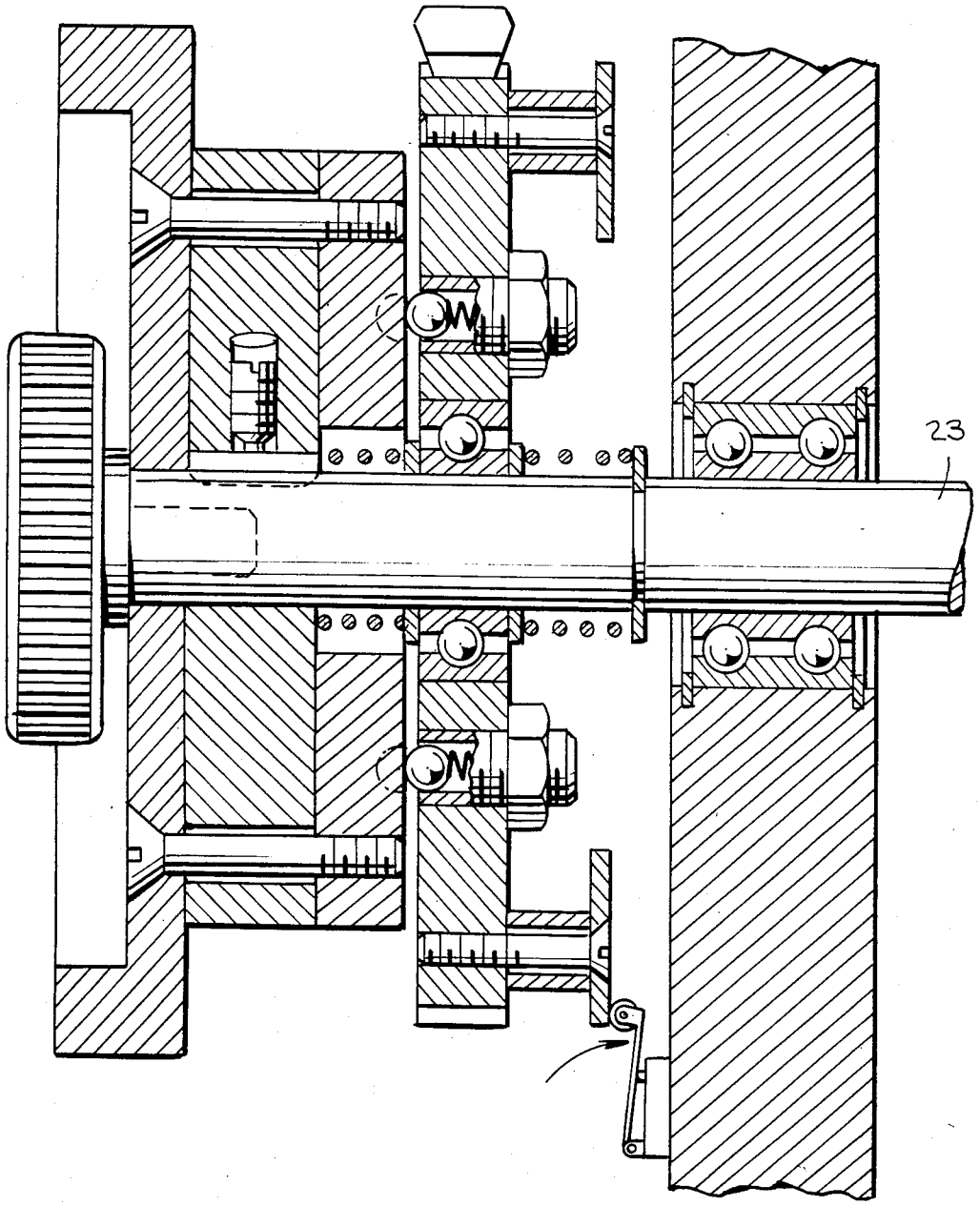

FIGS. 14 and 15 are detail views, partly in cross-section, of the clutch means of the rotary head of the invention. FIG. 14 shows the clutch engaged and FIG. 15 shows the clutch disengaged.

Figure 16:
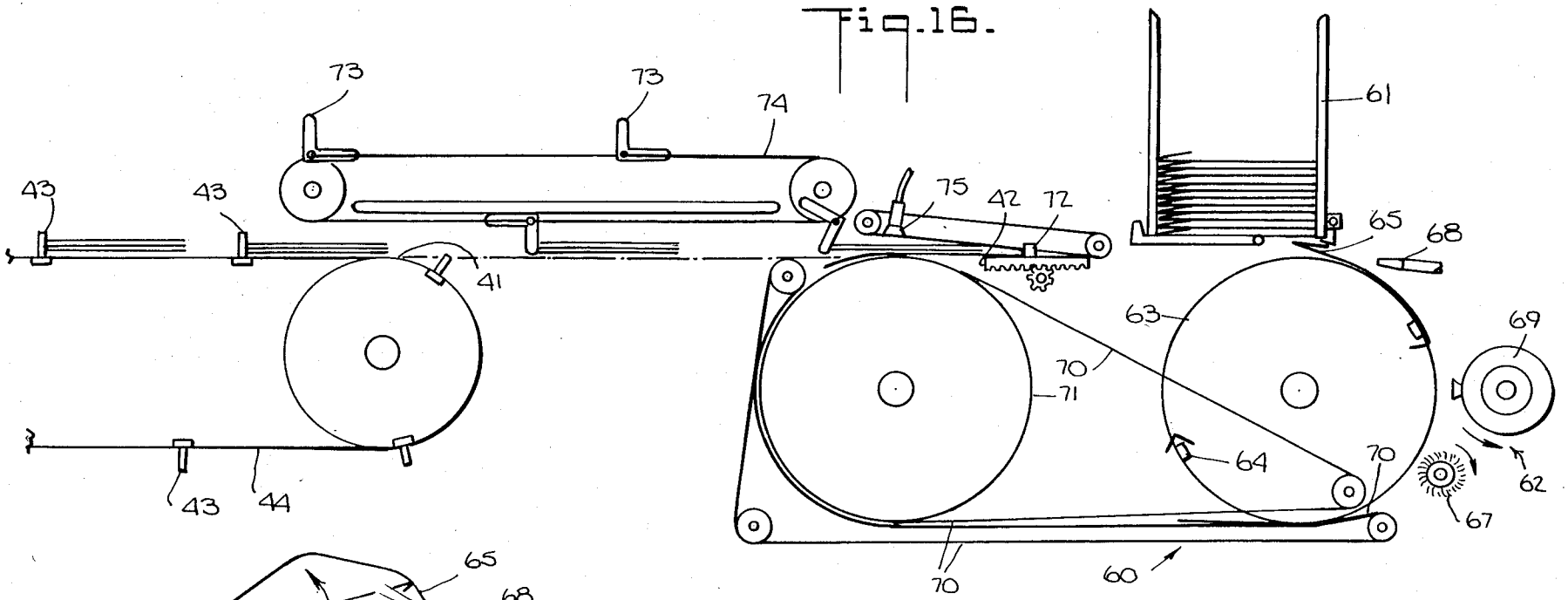

FIG. 16 is a front view, partly schematic of the envelope feed means of the inventor.

Figure 19:
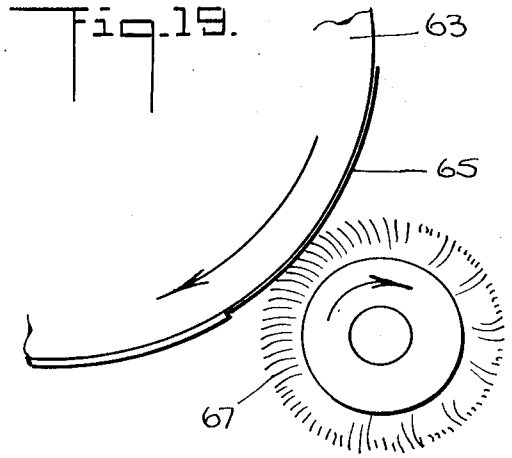
Figure 18:
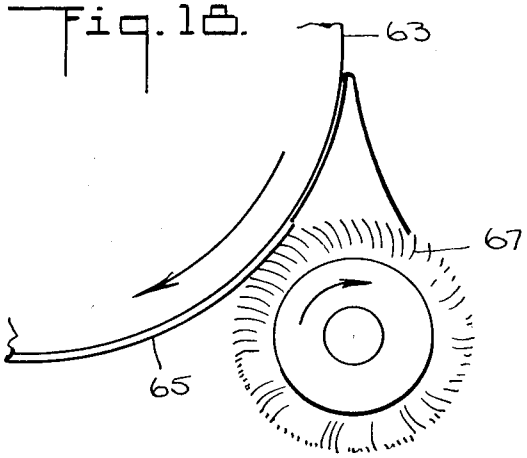
Figure 17:
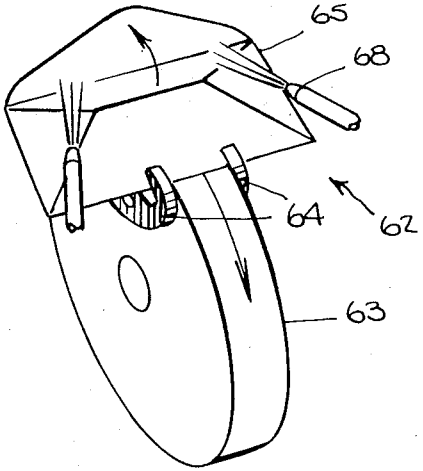

FIGS. 17, 18 and 19 are schematic views of envelope flap opening means. FIG. 17 shows air jets blowing the flap and FIGS. 18 and 19 show the flap being brushed open.

Figures 6, 20:
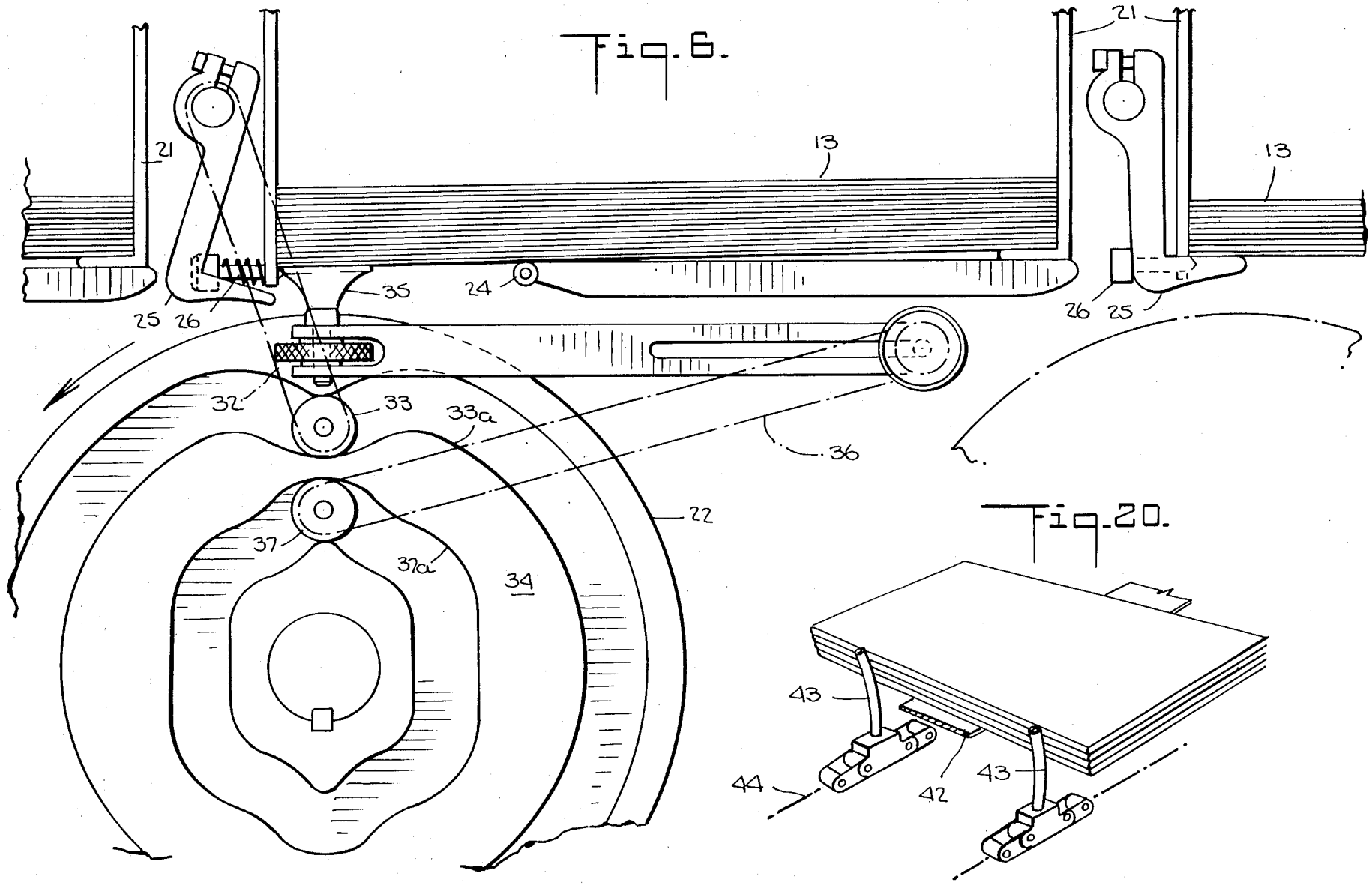
FIG. 6 is a front view of the rotary head feed station means, partly schematic and partly enlarged, showing the cam-actuated insert stack support divider and suction cup means.

FIG. 20 is a schematic view of the collating conveyor means collating pushers of the present invention.

Figures 21, 22:
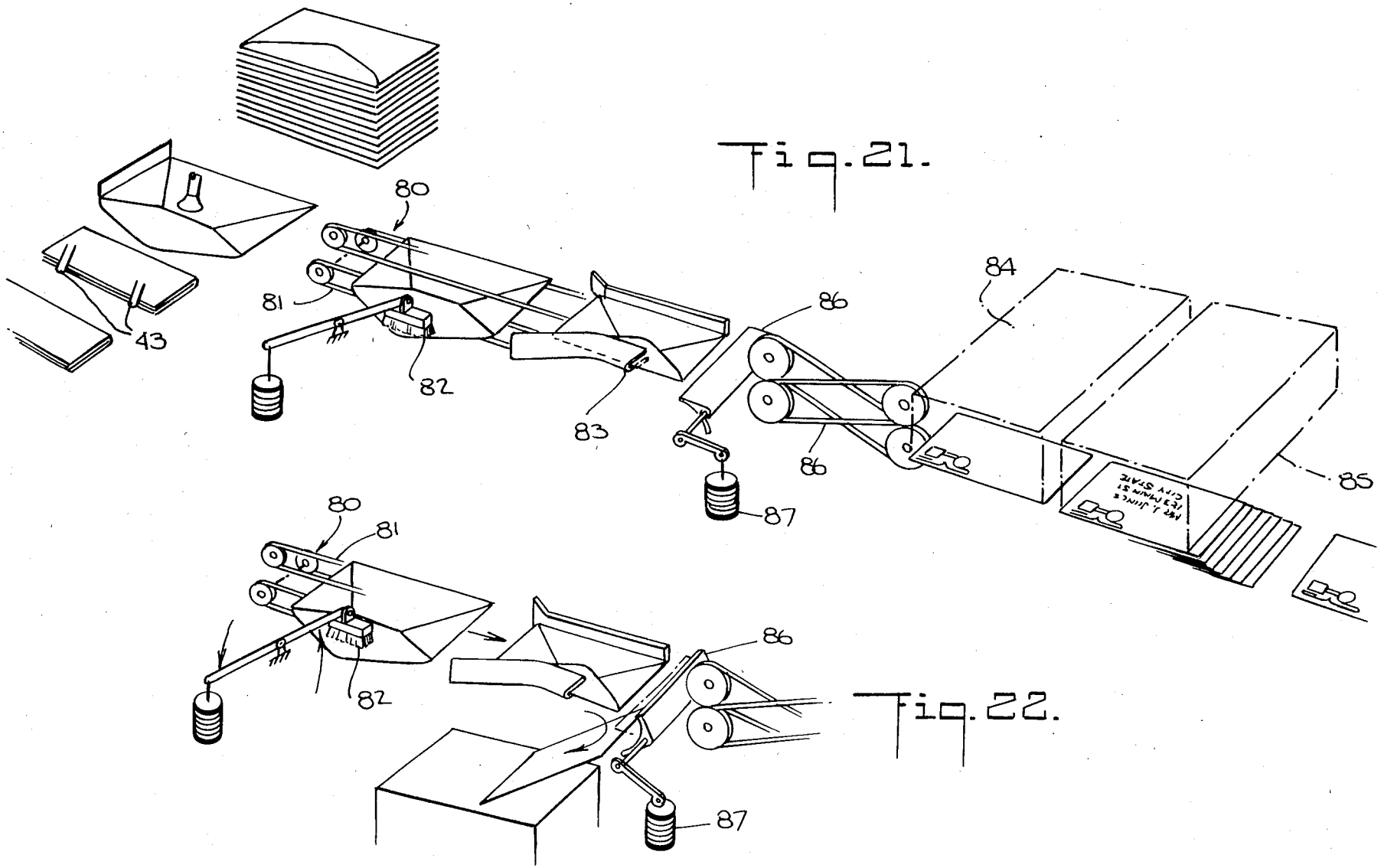

FIG. 21 is a perspective view, partly schematic, showing the collated inserts being fed into an opened envelope, the filled envelope being sealed, inverted and having postage and address applied. The diverter gate means is also shown.

FIG. 22 is a perspective view, partly schematic, of the diverter gate means in operative position for diverting a rejected envelope.

DESCRIPTION OF THE PREFERRED EMBODIMENT

Referring to the drawing, the multiple-rotary head collator inserter 10 of the present invention comprises a support frame 12 upon which is mounted the drive, control and operating means of the invention.

A plurality of rotary feed station means 20 are mounted on support frame 12 above collating insert conveyor means 40. Envelope feed means 60 is mounted to support frame 12 near the discharge end 41 of insert conveyor means 40 and opens and feeds envelopes to an insert point 42 near discharge end 41. Outflow conveyor means 80, mounted near insert point 42, removes filled envelopes for further processing.

Figure 5:
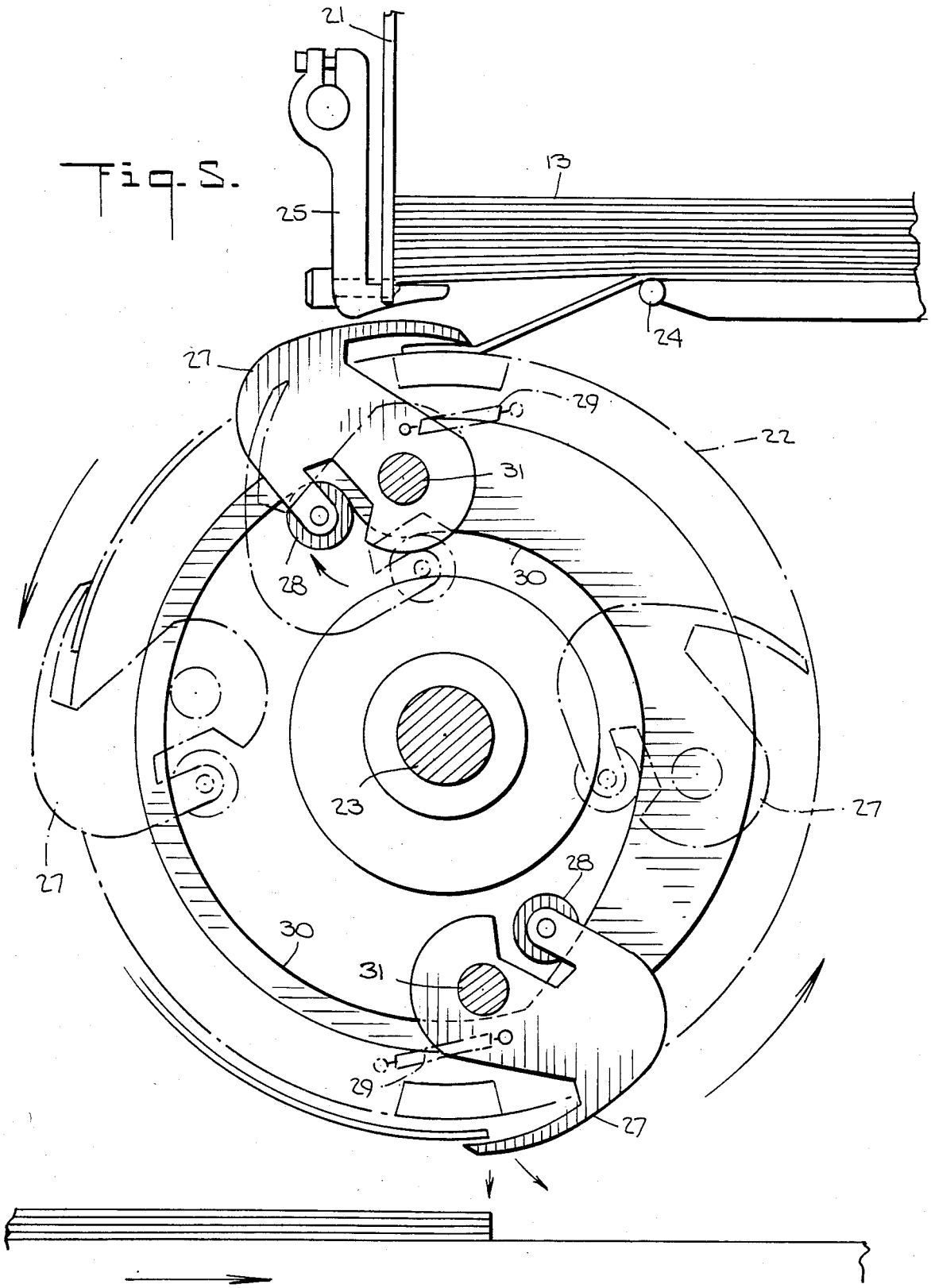
FIG. 5 is a front view of a rotary head and gripper means, partly schematic and partly in phantom, showing cam-operated gripper means engaging the bottommost sheet at the top of the rotation and disengaging an insert onto the collating conveyor at the bottom of the rotation.

Each rotary feed station means 20 comprises an open-bottom hopper 21 mounted above a rotary head 22 mounted on a drive shaft 23. A stack of inserts 13, normally folded sheets of printed material intended for mass mailing, are located in hopper 21 and are supported on an adustable support roller 24, a holder-divider 25 and adjustable separator screws 26. As shown in FIG. 5, at least one pair of insert grippers 27 are pivotally mounted on opposite sides of rotary head 22 and are opened and closed by means of a cam follower 28 spring-urged by spring 29 to ride against stationary cam means 30. The contour of stationary cam means 30 together with the location of gripper pivot 31 and the geometry of gripper 27 are such that, as rotary head 22 rotates counter clockwise as viewed in FIGS. 5 and 7–9, gripper 27 will rotate clockwise at the top of rotary head 22 to close onto and engage the lowermost insert against rotary head 22, then pulling that insert around to the bottom of rotary head 22 and releasing it onto collating insert conveyor means 40.

Figure 7:
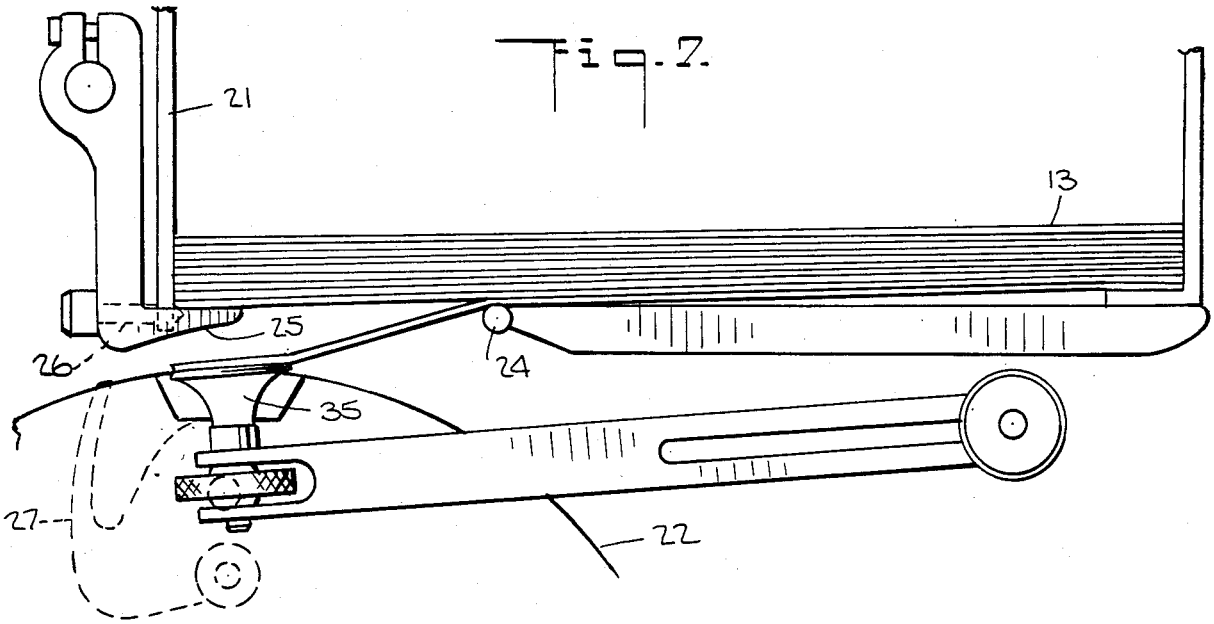
FIGS. 7, 8 and 9 are sequential operating front views of the divider, suction cup and gripper means shown in FIG. 6.
Figure 8:
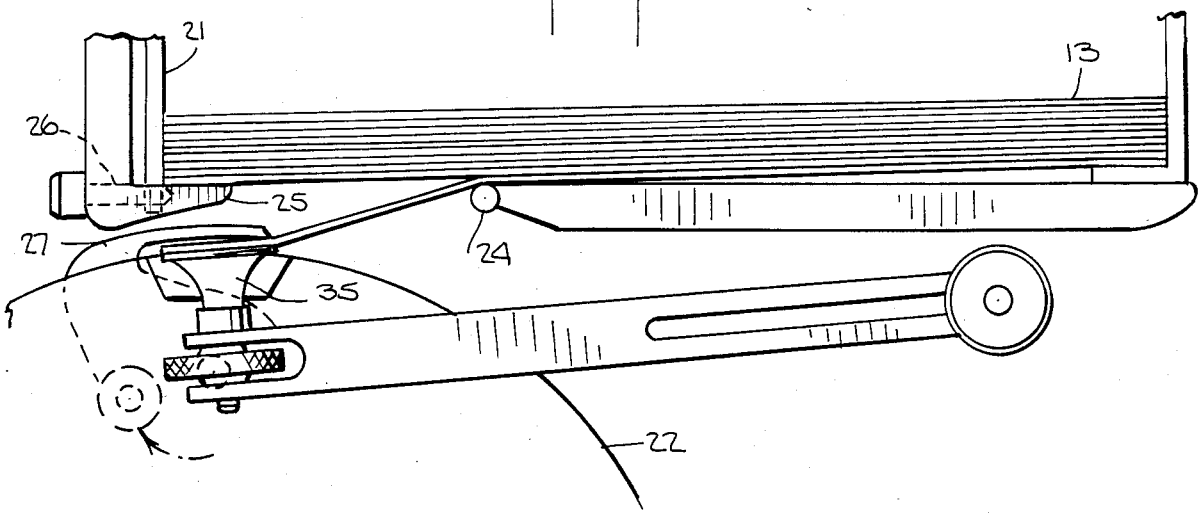
Figure 9:
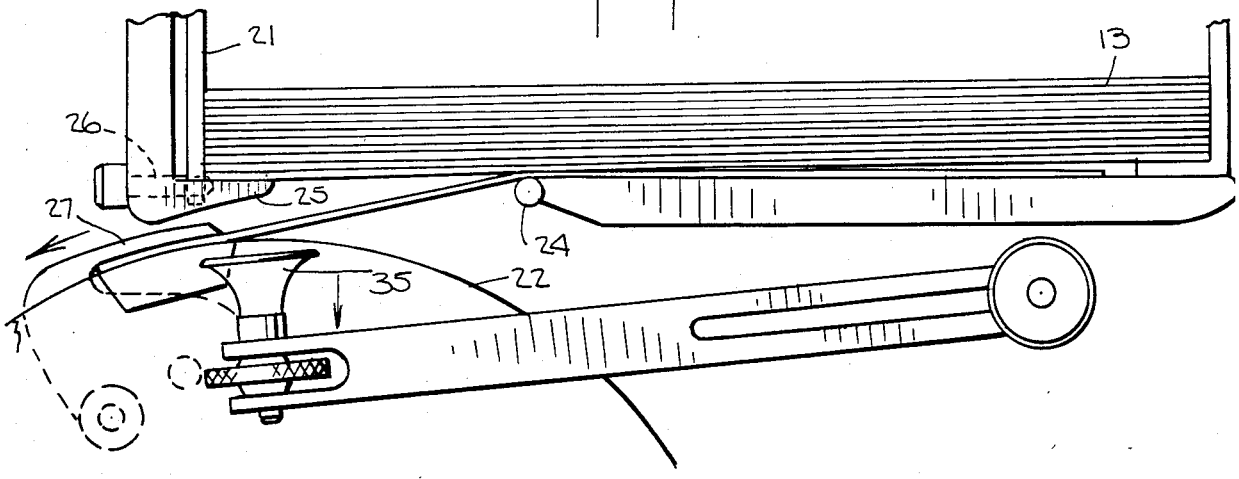

As shown in FIG. 6, holder-divider 25 is pivotally mounted together with linkage 32 to a cam follower 33 which engages a cam face 33*a* of rotating cam means 34 which rotates with rotary head 22. A vacuum-actuated suction cup 35, also pivotally mounted together with a linkage 36 to a cam follower 37 engaging a second face 37*a* of rotating cam means 34, engages the bottom of the lowermost insert 13 and engages an edge of the insert at the same time holder-divider 25 is pivotally retracted as shown in FIG. 6. Suction cup 35 then pulls the edge of the insert down, the remaining stack of insert 13 being held in position by separator screws 26 until holder-divider 25 pivots back to hold the stack of inserts 13 as shown in FIG. 7. Gripper 27 then engages the pulled edge of the bottom insert as aforesaid and as shown in FIG. 8, with the vacuum to suction cup 35 being turned off to release the insert and permit it to be pulled around with rotary head 22.

Collating insert conveyor means 40 comprises a conveyor belt 42 extending beneath each rotary feed station means 20.

A plurality of flexible collating pushers 43 mounted on conveyor chain 44 extend at spaced intervals therefrom and above conveyor belt 42. Conveyor chain 44 and collating pushers 43 move at the circumferential speed of rotary head 22 while conveyor belt 42 moves somewhat slower although in the same direction. When each rotary head 22 releases an insert 13 and drops it onto conveyor belt 42 and onto any previously deposited inserts, the slower moving conveyor belt 42 tends to retard the insert against the next set of pushers 43, thereby collating the inserts for proper alignment and subsequent insertion into an envelope.

Envelope feed means 60 comprises envelope hopper means 61 disposed above envelope opening means 62. Envelope opening means 62 comprises a rotary head 63 having a plurality of gripper means 64 located on its periphery to engage the lowermost envelope 65 from hopper means 61 and rotationally pull it past flap opening means 66. The operation of envelope gripper means 64 is not unlike the operation of insert grippers 27. Flap opening means 66 comprises rotating brushes 67 and air jets 68 and may additionally or alternatively include rotating suction means 69, all adapted to open the flap of envelope 65.

Figure 1:
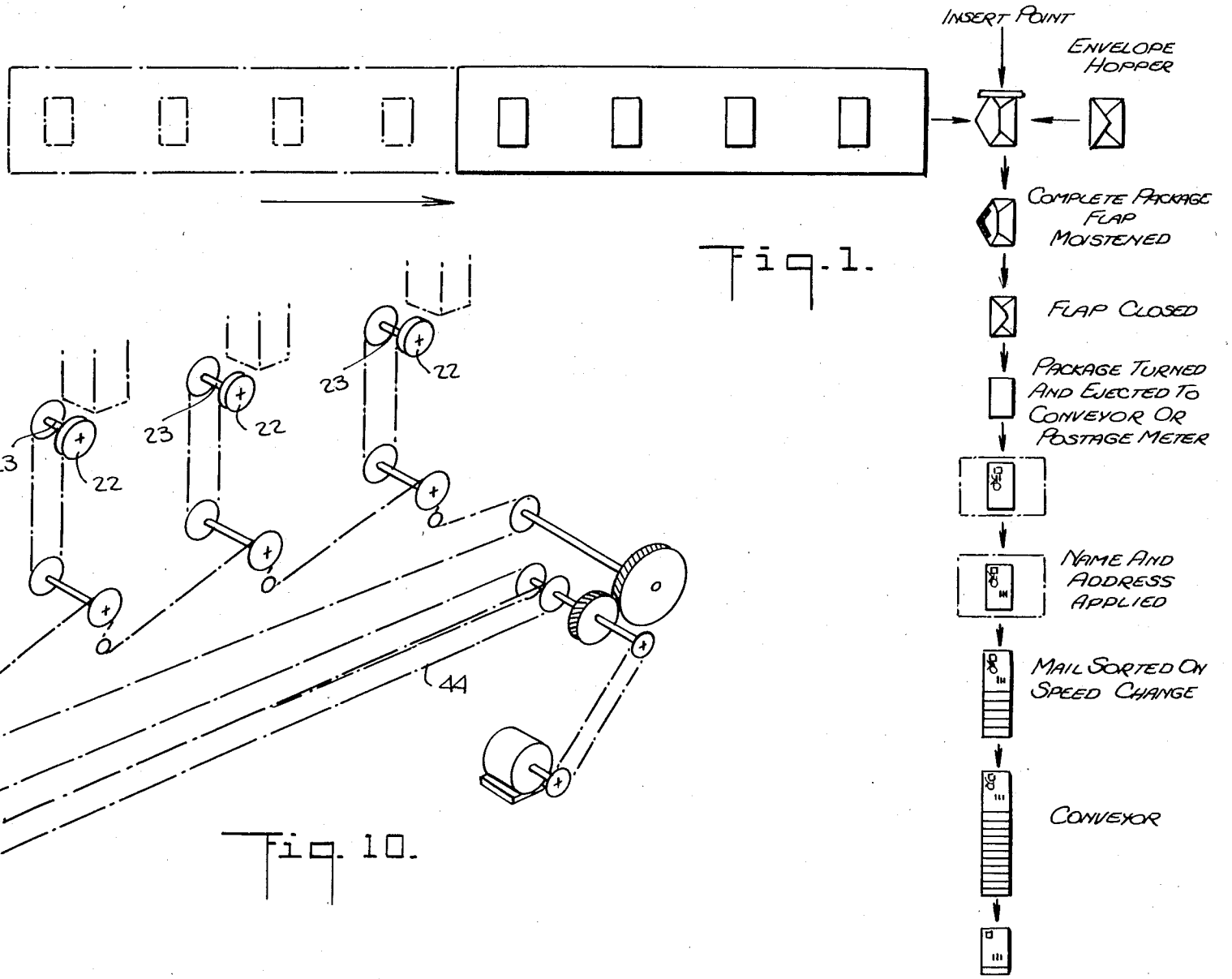
Figure 10:
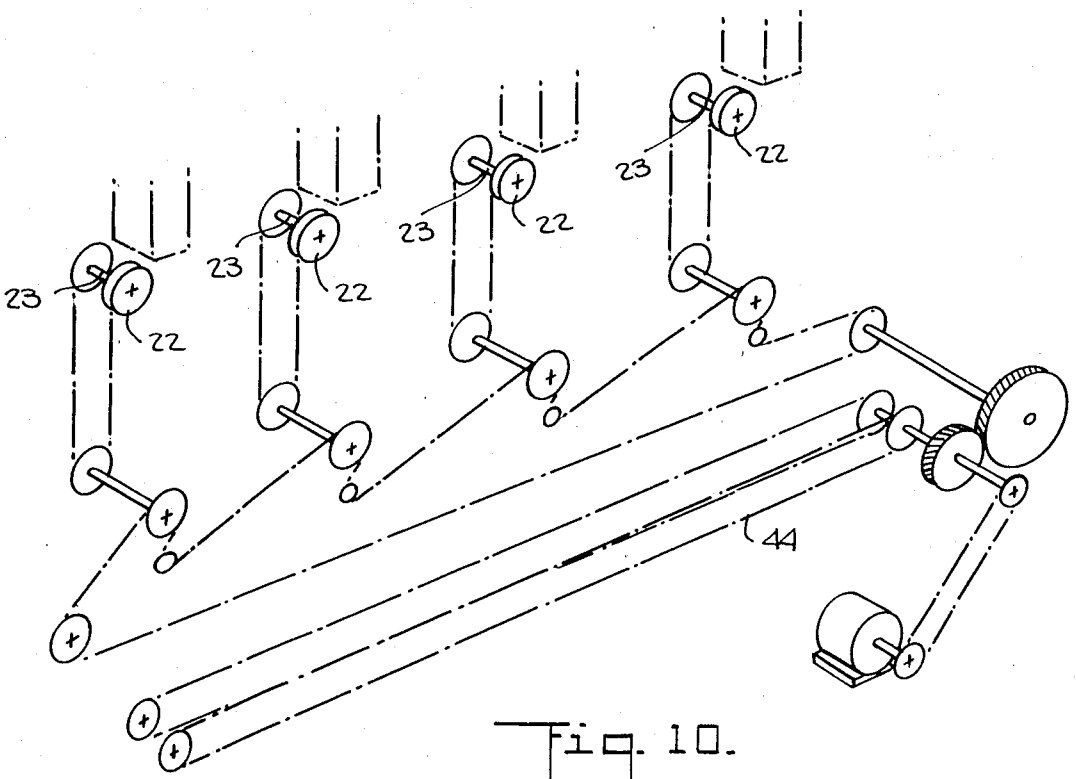
FIG. 10 is a schematic view of the drive means of the invention.
Figure 2:
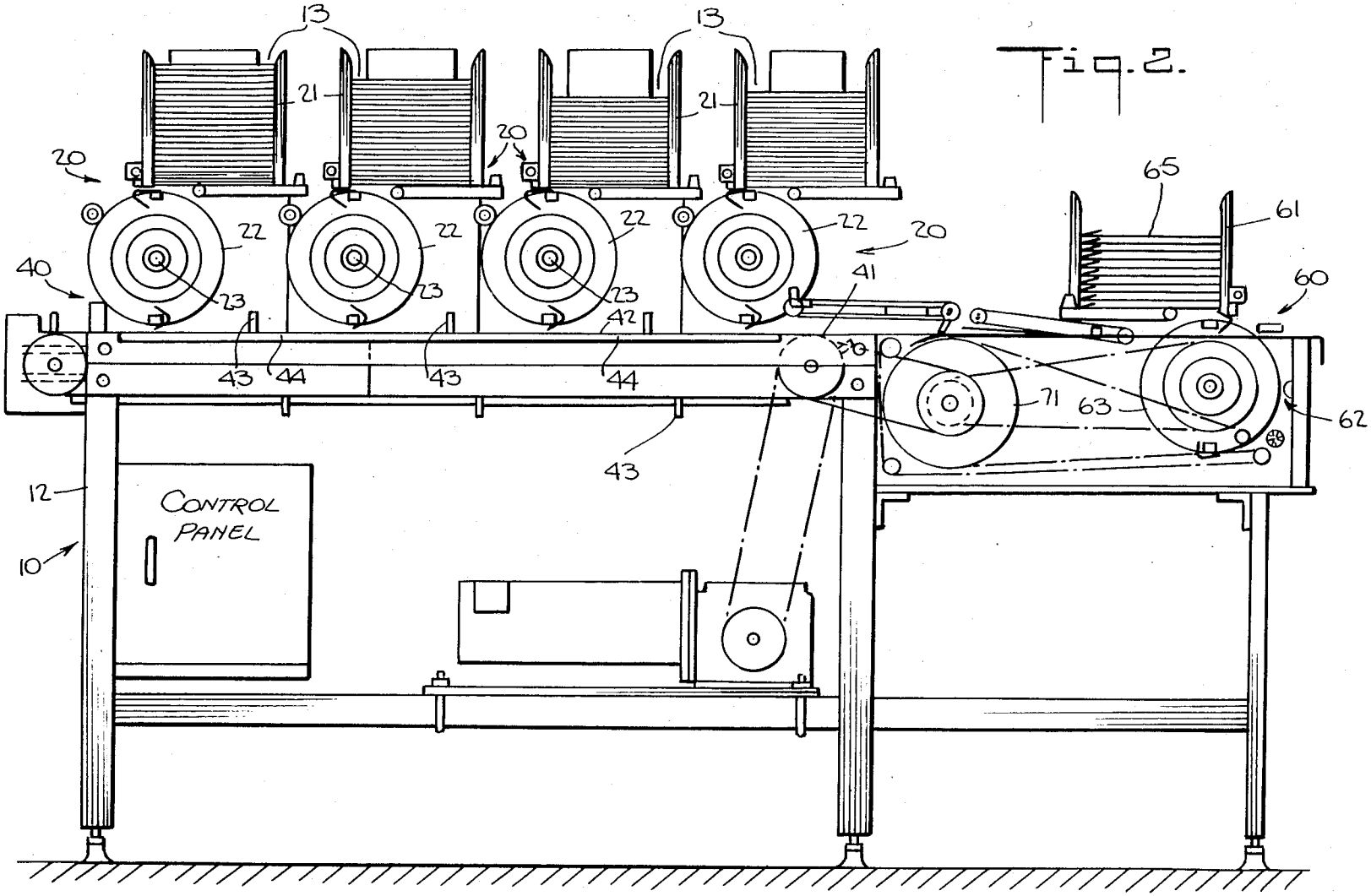
FIG. 2 is a front plan view, partly schematic, showing the multiple rotary feed station means located above collating insert conveyor means, moving from left to right in the view, envelope feed means delivering open envelopes to the insert point, pusher means for pushing inserts into the envelope, and drive means.
Figure 3:
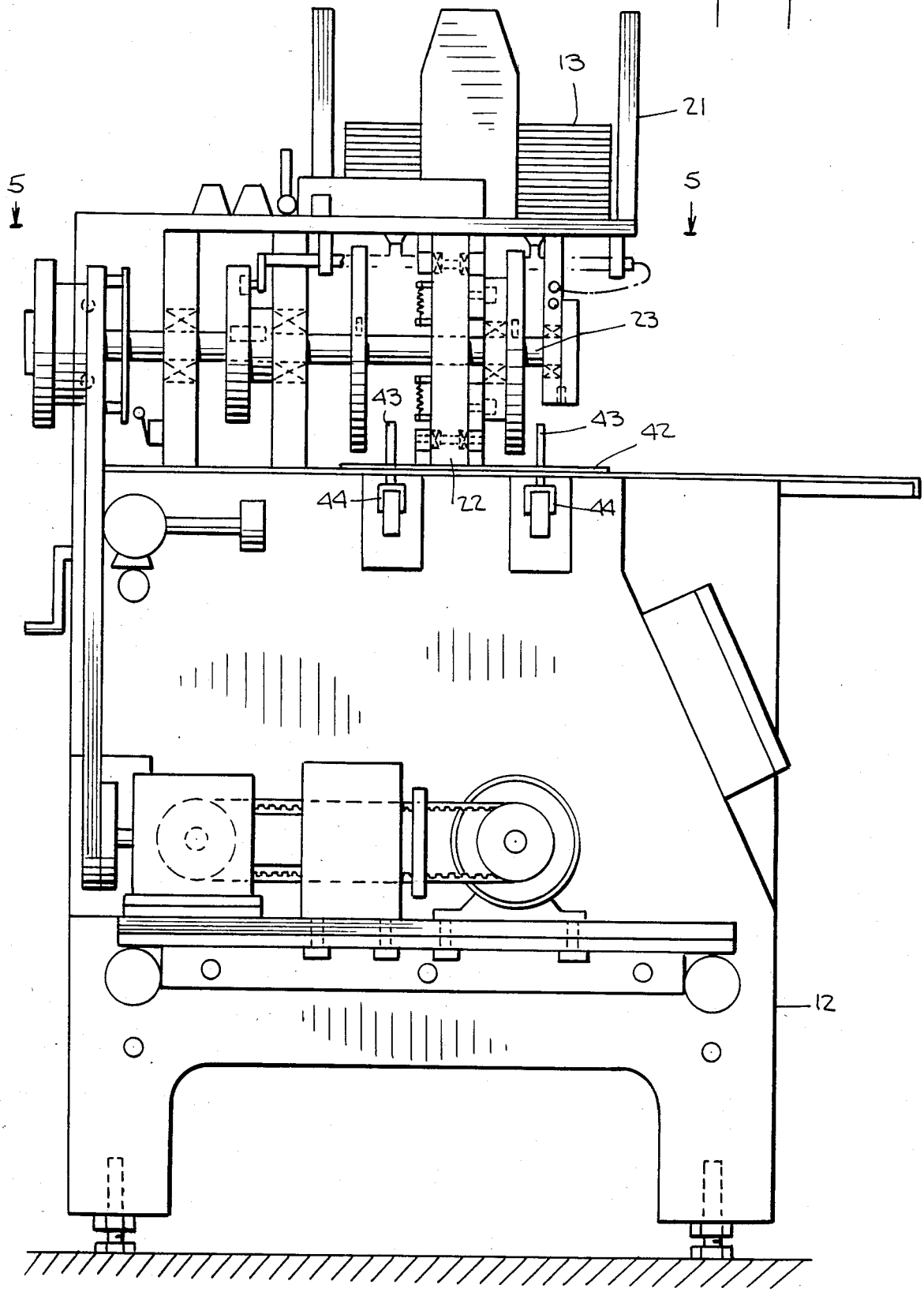
FIG. 3 is a left view of a rotary feed station, schematic, showing the drive shaft means.
Figure 4:
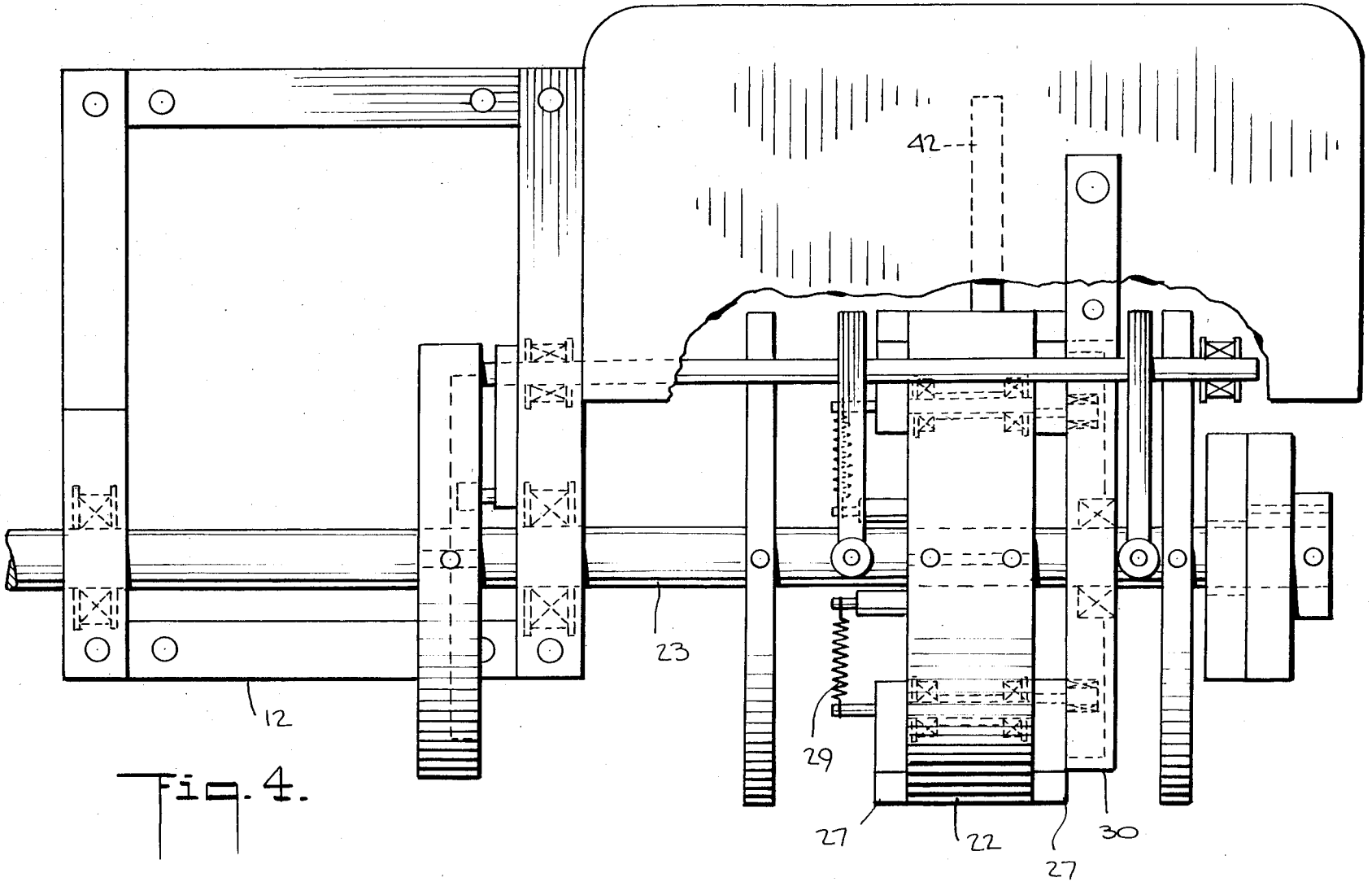
FIG. 4 is a top view of a rotary feed station, showing the drive shaft means and the rotary gripper means.

In the orientation shown in FIGS. 2, 16 and 21, envelopes 65 are stacked in hopper 61 with their flaps on the top and with the flap and envelope opening facing toward the incoming flow of inserts 13 on conveyor belt 42. As so viewed, rotary head 63 pulls the envelopes around in a clockwise direction with flap opening means 66 operating against that direction with rotating brushes 67, rotating clockwise providing a reverse direction brushing of the envelope flap which they contact. Rotary head 63 continues to pull envelopes 65 around its periphery to a pair of facing envelope delivery conveyor belts 70 which carry the envelopes between them around a wheel 71 up to a stop 72 at insert point 42 in line with but past discharge end of 41 collating conveyor means 40.

A plurality of pusher lugs 73, located on an overhead pusher chain 74 which spans from at least the discharge end 41 of collating means 40 to just before stop 72, moving faster than collating pushers 43, moves each collated stack of inserts to insert point 42 and inserts them into envelopes 65. Envelopes 65, having had their flaps opened as described, are each further opened by means of a suction opener 75 to more easily receive the inserts.

Outflow conveyor means 80 comprises a plurality of belts 81, arranged perpendicularly to collating conveyor means 40, extends from insert point 42 to a series of filled-envelope processing stations such as a flap-adhesive moistener brush 82, a flap closer 83, postage meter 84 and address applicator 85. Because envelopes 65 are generally address-side down at insert point 42, a turn-belt assembly 86 is provided prior to postage meter 84 and address applicator 85 to flip the envelopes address-side up.

At the end of outflow conveyor means 80 and before postage meter 84 is a divert gate means 86 which is solenoid actuated by vacuum or electrical solenoid 87 to divert selected envelopes before postage is applied, See FIGS. 21 and 22. While divert gate 86 can be used for any selection process, such as selecting which envelopes are to be hand-delivered, or which are to have further processing such as insertion of additional material, the principal function intended is to divert defectively filled envelopes away from the postage meter and address applicators thus assuring that only properly filled envelopes will be mailed. For this principal function divert gate 86 is controlled, through suitable memory and timing circuit means, by misfeed detector means 90.

Misfeed detector means 90, shown in FIGS. 11, 12 and 13, comprises detector roller 91 mounted on a lever 92 spring-urged adjacent each rotary head 22. A preferred position is to pivotally mount lever 92 on hopper 21 by a support 93. Roller 91 is deflected away from rotary head 22 by the thickness of insert material held in gripper 27. Such deflection, amplified by the length of the lever-arm on the opposite side of the pivot, is used to actuate a detector 94, comprising photocells 95 located where a flag 96 on the upper end of the lever-arm is positioned for more than normal thickness inserts (see a double-feed in FIG. 12) or less than normal-thickness inserts (see no feed in FIG. 13). In either case flag 96, blocking light to a photocell 95, actuates a signal which, when processed by suitable memory and delay circuit control means, will cause a defectively filled envelope to be diverted by divert gate 86 when it reaches the gate. A normal-thickness insert will locate flag 96 away from photocells 95 and will not cause any diverting signal.

A sheet-sensing or detection means 99 as shown schematically in FIGS. 11–13 is intended to be the type as described in U.S. Pat. No. 3,371,331, issued Feb. 27, 1968, at col. 2, line 55 et seq., incorporated herein by reference. Such a sheet-sensing or detection means senses either the absence of an insert sheet or a multiple insert sheet, either of which constitutes a misfeed, by means of a switch actuated alarm, either audible or visible or both, and which may be connected to memory and delay circuit control means for subsequent actuation of divert gate 86 when the misfeed reaches that position.

Rotary head 22 is shown in FIG. 5 to have at least one pair of insert grippers 27 mounted on opposite sides of the head. It is contemplated that additional insert grippers may be utilized, preferably an additional pair mounted on opposite sides of rotary head 22 such that the head comprises four gripper locations circumferentially equidistant from each other. When relatively thin or small inserts 13 are to be fed, all four grippers 27 may be utilized so that with each full rotation of rotary head 22 four inserts are removed from hopper 21 and sequentially deposited on insert conveyor means 40. For heavier, stiffer, larger or otherwise less easily manipulated inserts 13, fewer grippers may be employed, with two or in extreme cases only one gripper utilized.

With a series of rotary heads 22 each for having four insert grippers 27, the invention takes on an added dimension of flexibility for high speed operation. Each head may deposit inserts onto conveyor belt 42 at every second, third or forth set of pushers 43, or at even greater intervals between pushers, with subsequent rotary heads depositing at the intermediate pusher locations. This manner of alternate deposit of inserts onto the conveyor reduces misfeeds since rotational speed and operation of each head is reduced yet overall machine throughput can be increased.

While the foregoing is illustrative of a preferred embodiment of the invention, other embodiments and modifications are within the spirit of the invention and the following claims.

What is claimed is:

1. Mailing machine having collating, inserting, sealing and defect rejection funcitons, comprising:

a. rotary feed means, said rotary feed means comprising a plurality of rotary feed station means;

b. collating means, said collating means comprising insert conveyor means having a discharge end, said rotary feed station means being positioned in any array above and feeding inserts onto said insert conveyor means;

c. envelope feed means, said envelope feed means comprising envelope delivery conveyor means for delivering envelopes to an insert point;

d. insert pusher means, said insert pusher means comprising means for inserting said inserts into said envelopes at said insert point;

e. outflow conveyor means, said outflow conveyor means comprising means for conveying said envelopes with said inserts from said insert point to postage meter and address stations;

f. misfeed detector means, said misfeed detector means comprising means for detecting improper feed of inserts from said rotary feed means to said collating means;

g. divert means, said divert means comprising means for diverting envelopes having improper inserts away from said postage meter and addressing stations;

h. circuit means, said circuit means comprising means for storing information as to misfeeds received from said misfeed detector means and for selectively actuating said divert means at the appropriate time when an envelope containing improper inserts reaches said divert means; and i. drive means, said drive means comprising means for driving all moving parts of said mailing machine in appropriately timed relation, whereby inserts are collated, inserted into envelopes, metered and addressed for mailing.

2. A mailing machine in accordance with claim 1, wherein said rotary feed means comprises a plurality of rotary feed station means each comprising:

a. open-bottom hopper means for holding a stack of inserts; and b. rotary head means, said rotary head means comprising a plurality of gripper means, siad gripper means being located and adapted to grip the bottom-most insert in said open-bottom hopper means, withdraw such insert therefrom and deposit it on said insert conveyor means.

3. A mailing machine in accordance with claim 2, wherein said open-bottom hopper means comprises:

a. holder-divider means, said holder-divider means comprising retractable insert holding means and adjustable separator means, said retractable insert holding means supporting the stack of inserts when not retracted and releasing at least the bottom-most insert in the stack when retracted, said adjustable separator means comprising means to separate the bottom-most insert from the remainder of the stack and being adjustable for insert characteristics including thickness, weight, flexibility and the like.

4. A mailing machine in accordance with claim 3, wherein said retractable insert holding means comprises means actuated in cooperation with said rotary head means for retracting said insert holding means from its stack-supporting position when said gripper means are in operative gripping position to grip the bottom-most insert and returning said insert holding means to its stack-supporting when said gripper means have removed the bottom-most insert from the stack.

5. A mailing machine in accordance with claim 3, wherein said retractable insert holding means comprises pivotally-mounted holder-divider means connected by linkage means to cam means, said cam means being actuated by rotation of said rotary head means.

6. A mailing machine in accordance with claim 5, wherein said cam means comprises rotating cam means affixed to rotate with said rotary head means.

7. A mailing machine in accordance with claim 2, wherein said gripper means comprises:

a. pivotally-mounted insert gripper means pivotally mounted to said rotary head means; and b. gripper actuating means, said gripper actuating means comprising means for actuating said insert gripper means to grip and release inserts in cooperation with said rotary head means.

8. A mailing machine in accordance with claim 7, wherein said gripper actuating means comprises stationary coin means pivotally actuating said insert gripper means to grip the bottom-most insert when said rotary head means rotates said insert gripper means to operative gripping position and to release said insert when said rotary head means rotates said insert gripper means to operative releasing position to deposit said insert on said insert conveyor means.

9. A mailing machine in accordance with claim 3, comprising:

a. rotating cam means, said rotating cam means rotating in association with said rotary head to actuate said holder-divider means; and b. stationary cam means, said stationary cam means actuating said gripper means as said gripper means rotates in association with said rotary head;

c. whereby said holder-divider means is retracted to relese the bottom-most in timed association with the rotational location of said gripper means to grip said released bottom-most insert; and d. whereby said holder-divider means is returned to stack-supporting position when the bottom-most insert has been removed from the stack by continued rotation of said gripper means.

10. A mailing machine in accordance with claim 1, wherein said insert conveyor means comprises:

a. conveyor belt means, said conveyor belt means operatively connecting from said rotary feed station means to said insert pusher means;

b. conveyor chain means, said conveyor chain means extending in operatively parallel relation with said conveyor belt means, said conveyor chain means comprising collating pusher means, said collating pusher means engaging a pile of inserts on said conveyor belt means;

c. said drive means driving said conveyor chain means at a relatively faster speed, and driving said conveyor belt means at a relatively slower speed;

d. whereby inserts piled on said conveyor belt: moving slower than said collating pusher means, are collated in proper alignment against said collating pusher means.

11. A mailing machine in accordance with claim 1, wherein said envelope feed means comprises:

a. envelope hopper means;

b. rotary head means;

c. envelope opening means; and d. envelope delivery means;

e. said rotary head means being disposed between said envelope hopper means and said envelope delivery means;

f. whereby envelopes are withdrawn from the bottom of said envelope hopper means, rotated past said envelope opening means and inserted into said envelope delivery means by said rotary head means.

12. A mailing machine in accordance with claim 11, wherein said envelope hopper means comprises:

a. open-bottom hopper means; and b. envelope retaining means, said envelope retaining means comprising means, located at the bottom of said open-bottom hopper means, for retaining the stack of envelopes therein while allowing access to and withdrawal of the bottom-most of said envelopes therein by said envelope gripper means.

13. A mailing machine in accordance with claim 11, wherein said rotary head means comprises:

a. at least one rotary head;

b. envelope gripper means, said envelope gripper means being disposed on and extending from said rotary head;

c. said envelope gripper means gripping the bottom-most envelope in said envelope hopper means, withdrawing said envelope, rotating it past said envelope opening means, inserting it into said envelope delivery means and releasing it.

14. A mailing machine in accordance with claim 11, wherein said envelope opening means comprises:

a. rotating vacuum flap opening means, said rotating vacuum flap opening means comprising vacuum means adapted to engage and open the envelope flap;

b. counter-rotating brush means, said counter-rotating brush means rotating counter to rotation of said rotary head means;

c. whereby the envelope flap is further opened and laid substantially flat against said rotary head means.

15. A mailing machine in accordance with claim 11, wherein said envelope delivery means comprises:

a. multiple conveyor means, said multiple conveyor means comprising a plurality of envelope delivery conveyor belts which face each other in sufficiently close relationship so as to grip and convey envelopes from an entry point at said rotary head means to a discharge point adjacent said insert point;

b. whereby envelopes with open flaps are delivered by said rotary head means into said entry point;

c. said envelopes being conveyed with open flaps to said discharge point by said envelope delivery conveyor belts with the envelope opening facing toward the incoming collated inserts;

d. said insert pusher means pushing said collated inserts into said open envelopes.

16. A mailing machine in accordance with claim 15, wherein said multiple conveyor means additionally comprises direction changing means to change the direction of the envelopes to present the openings thereof to face incoming collated inserts at said insert point.

17. A mailing machine in accordance with claim 11, wherein:

i. said envelope hopper means comprises:

a. open-bottom hopper means;

b. envelope retaining means, said envelope retaining means comprising means, located at the bottom of said open-bottom hopper means, for retaining the stack of envelopes therein while allowing access to and withdrawal of the bottom-most of said envelopes therein by said envelope gripper means;

ii. said rotary head means comprises:

a. at least one rotary head;

envelope gripper means, said envelope gripper means being disposed on and extending from said rotary head;

c. said envelope gripper means gripping the bottom-most envelope in said envelope hopper means, withdrawing said envelope, rotating it past said envelope opening means, inserting it into said envelope delivery means and releasing it;

iii. said envelope opening means comprises:

a. rotating vacuum flap opening means, said rotating vacuum flap opening means comprising vacuum means adapted to engage and open the envelope flap;

b. counter-rotating brush means, said counter-rotating brush means rotating counter to rotation of said rotary head means;

c. whereby the envelope flap is further opened and laid substantially flat against said rotary head means; and iv. said envelope delivery means comprises:

a. multiple conveyor means, said multiple conveyor means comprising a plurality of envelope delivery conveyor belts which face each other in sufficiently close relationship so as to grip and convey envelopes from an entry point at said rotary head means to a discharge point adjacent said insert point;

b. whereby envelopes with open flaps are delivered by said rotary head means into said entry point;

c. said envelopes being conveyed with open flaps to said discharge point with the envelope opening facing toward the incoming collated inserts;

d. said insert pusher means pushing said collated inserts into said open envelopes.

18. A mailing machine in accordance with claim 15, wherein said multiple conveyor means additionally comprises direction changing means to change the direction of the envelopes to present the openings thereof to face incoming collated inserts at said insert point.

19. A mailing machine in accordance with claim 1, wherein said misfeed detector means comprises:

a. lever means, said lever means being pivotally secured adjacent each said rotary feed station means;

b. detector roller means, said detector roller means being mounted to said lever means on a first side of the pivot thereof, said detector roller means being adapted to roll against inserts on said rotary feed means;

c. detector means, said detector means being mounted to said lever means on the side of the pivot of said lever means opposite said first side;

d. said detector means detecting the thickness of said inserts by deflections of said lever means and providing electrical signals in response thereto.

20. A mailing machine in accordance with claim 19, wherein said circuit means comprises memory and delay circuit control means whereby electrical memory is made electrical signals generated by a misfed insert, as detected by said misfed detector means, to provide delayed actuation of said divert means when the misfed insert reaches the location of said divert means.

21. A mailing machine in accordance with claim 20, wherein said divert means comprises gate means.

* * * * *